US006558615B1

(12) United States Patent
Jungblut

(10) Patent No.: US 6,558,615 B1
(45) Date of Patent: May 6, 2003

(54) ANNEALING BASKET FOR DEGREASING AND SOFTENING ALUMINUM PARTS

(75) Inventor: Gottfried Jungblut, Wehr (DE)

(73) Assignee: Aluminium Rheinfelden GmbH (DE)

( * ) Notice: Subject to any disclaimer, the term of this patent is extended or adjusted under 35 U.S.C. 154(b) by 0 days.

(21) Appl. No.: 09/830,453

(22) PCT Filed: Oct. 8, 1999

(86) PCT No.: PCT/EP99/07549

§ 371 (c)(1),
(2), (4) Date: Jun. 11, 2001

(87) PCT Pub. No.: WO00/24942

PCT Pub. Date: May 4, 2000

(30) Foreign Application Priority Data

Oct. 26, 1998 (EP) ..... 98811073

(51) Int. Cl.[7] ..... C21D 9/00
(52) U.S. Cl. ..... 266/274; 432/261
(58) Field of Search ..... 266/274, 262; 432/261, 251

(56) References Cited

U.S. PATENT DOCUMENTS 2,420,428 A * 5/1947 Hill et al. ..... 432/261
2,430,521 A * 11/1947 McCormick ..... 263/47
3,179,393 A * 4/1965 Bixby ..... 432/261
3,395,810 A * 8/1968 Johnson ..... 432/261
4,290,753 A * 9/1981 Klefisch ..... 432/251
4,463,864 A * 8/1984 Roach ..... 432/261
4,669,978 A * 6/1987 Klefisch ..... 432/261

FOREIGN PATENT DOCUMENTS

| | | |
|---|---|---|
| DE | 29 04 722 | 8/1980 |
| DE | 34 44 507 | 6/1986 |
| DE | 29721475 | 2/1998 |

* cited by examiner

*Primary Examiner*—Scott Kastler
(74) *Attorney, Agent, or Firm*—Bachman & LaPointe, P.C.

(57) ABSTRACT

An annealing basket made of steel, receiving mass-produced aluminium parts (20) for the degreasing and softening thereof, comprising a bottom and side by a frame. At least one side wall (16) is joined to the walls that protrude from said bottom and are defined frame (12) by means of at least one aluminium element (26) that can be plastically deformed when heated to an annealing temperature as a result of the pressure that is exerted on the side walls (16) and occurs in the annealing basket (10) due to thermal expansion of said aluminium parts (20), whereby the side wall (16) moves outwards to a certain degree under the effect of the increase in the volume of said basket in at least one area that is adjacent to the frame.

4 Claims, 1 Drawing Sheet

Fig.1
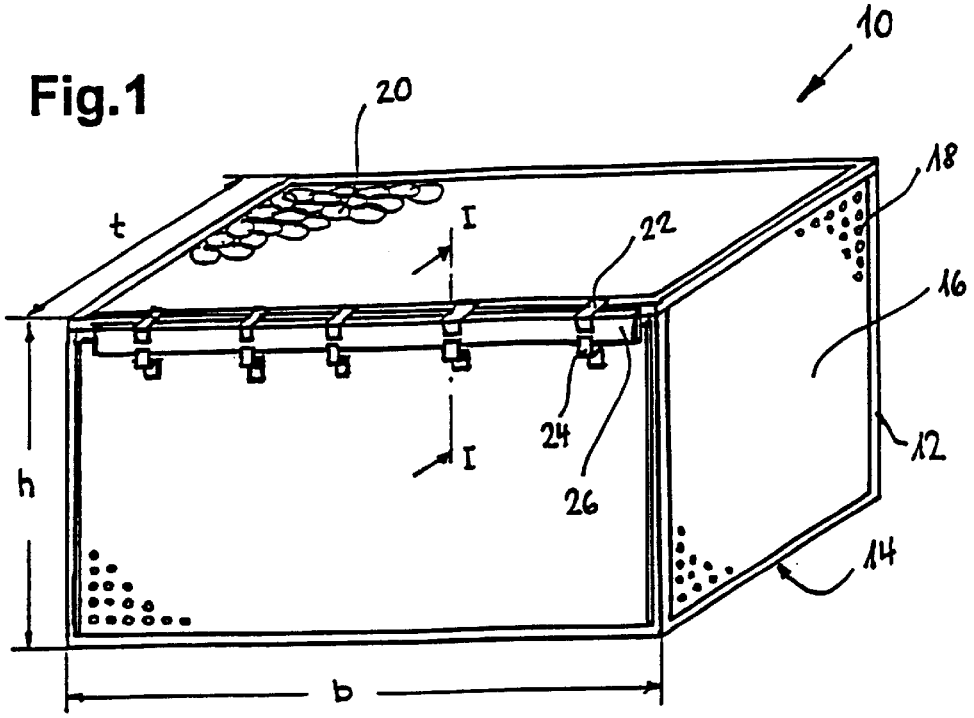
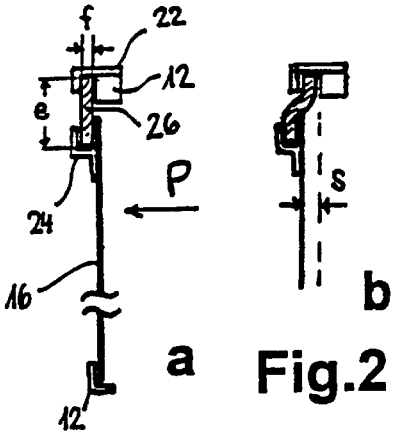
Fig.2
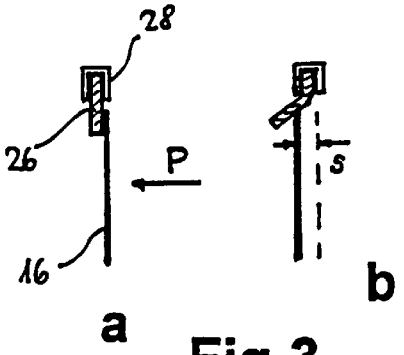
Fig.3
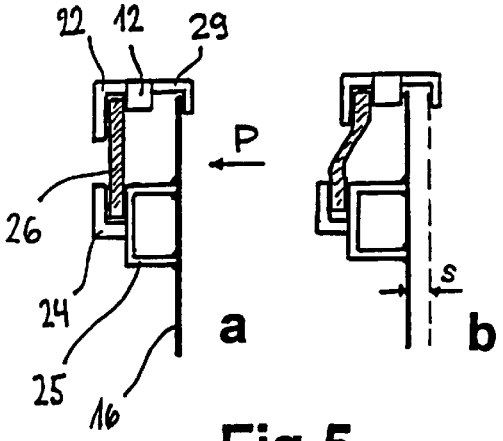
Fig.5
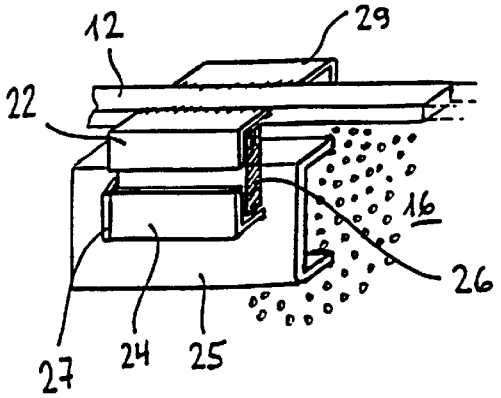
Fig.4

ANNEALING BASKET FOR DEGREASING AND SOFTENING ALUMINUM PARTS

The invention concerns a steel annealing basket for holding mass-produced parts of aluminium for degreasing and soft annealing, with a base and side walls bordered by a frame projecting from this.

Annealing baskets of the type described above are used for example for degreasing and soft annealing of aluminium slugs for the production of extruded can and tube bodies and technical extrusions. Annealing baskets of conventional design consist of a frame within which are welded the base and side walls. When heating the annealing basket filled with slugs to an annealing temperature in the range from 350 to 500° C., the lubricant film initially adhering to the surface of the slugs vaporises, so that the slugs lose their initial slip ability as the temperature increases. Due to the heat expansion of the slugs, a pressure directed towards the side walls builds up in the annealing basket and which, as a result of the great softening of the aluminium and the heat expansion, which is around three times greater in comparison with a steel basket, leads to material deformations, in particular on the edges of the punched slugs, which can lead to production problems and rejects in the subsequent processing of the slugs by extrusion moulding.

The invention is therefore based on the task of creating an annealing basket of the type stated initially with which the localised deformations occurring on the soft aluminium parts, due to the pressure build-up as a result of the heat expansion, can be avoided.

The problem is solved according to the invention in that at least one side wall is connected to the frame by way of at least one aluminium element which deforms plastically on heating to an annealing temperature under the pressure occurring in the annealing basket by the heat expansion of the aluminium parts against the side walls so that the side wall, under the expansion of the basket volume, is moved outwards by an extent in at least one area adjacent to the frame.

In the connection according to the invention between the frame and the side wall, the pressure, due to the plastic deformation of the element softening to the same extent as the aluminium parts, is reduced by the movement of the side wall.

In a first embodiment of the annealing basket according to the invention, brackets are attached at least on one side wall in an edge area opposite brackets which are attached to the frame, and these together form a holder space for insertion of the element. The element is preferably an aluminium profile or a plate with substantially rectangular cross-section.

The frame can also be formed as a U-shaped profile which is open at the base, and the element, formed as an aluminium profile with substantially rectangular cross-section, can be inserted into the U-shaped profile, and the side wall lies against the side of the aluminium profile in an edge area.

The annealing basket according to the invention can be used for degreasing or soft annealing of any sort of aluminium parts. A particularly preferred area of application is the degreasing and soft annealing of aluminium slugs for extrusion moulding of can and tube bodies and technical extrusions.

Further advantages, features and details of the invention arise from the following description of preferred embodiments, and the drawings which show diagrammatically:

FIG. 1 a perspective view of an annealing basket filled with slugs;

FIG. 2 a partial section through the annealing basket of FIG. 1 along line—in two operating states;

FIG. 3 a second embodiment of a connection between the frame and side wall of an annealing basket in two operating states;

FIG. 4 an oblique view of a third embodiment of a connection between the frame and the side wall of an annealing basket;

FIG. 5 the third embodiment of FIG. 4 in two operational states.

An annealing basket 10 shown in FIG. 1 for degreasing or soft annealing of mass-produced parts consists of steel frame parts 12 at right angles to each other and joined together to form a frame with an inserted base 14 and steel plate side walls 16 projecting from this. At least two opposing side walls 16, and where applicable also the base 14, are fitted with openings or perforations 18. The perforations 18 serve for the passage of hot gases through the mass-produced parts in the annealing basket 10 during their annealing in an annealing furnace which contains the annealing basket 10 and is not shown in the drawing for better clarity.

The annealing basket 10 has for example a width b and a depth t each of 1000 mm, the height h for example is 400 mm. In the example shown here, the mass-produced parts are punched slugs 20 made from high-grade aluminium which are intended for example for the extrusion of aerosol cans. The slugs have, by way of an example, a diameter of 60 mm and a thickness of 4 mm.

The base 14 and three of the side walls 16 are welded to the frame parts 12. One side wall 16 is inserted releasably in the frame and loosely attached to the upper frame part 12. Brackets 22 are welded to the upper frame part and brackets 24 to the side wall 16 aligned with each other such that in cross-section they form a holder area for form-fit passage of a profile 26 of high-grade aluminium with substantially rectangular cross-section, with for example a width e of 60 mm and a thickness f of 4 mm.

FIG. 2*a* shows the releasable connection between the side wall 16 and the upper and/or lower frame part 12 in a first operating state before annealing treatment of the slug 20. The lower frame part 12 in the example shown serves as a fixed stop. On the upper edge of the basket, the side wall 16 is releasably connected to the upper frame part 12 by way of the profile 26 inserted between the brackets 22, 24.

The surface of the slugs placed in the annealing basket for annealing is coated with a lubricant film from the preceding rolling and punching procedure, which when the slugs are placed in the annealing basket leads to practically unhindered slippage of the slugs 20 against each another and hence to a compact filling of the annealing basket 10. In the annealing furnace hot gases flow through the annealing basket 10 filled with slugs 20, where the slugs 20 during the annealing process are heated to a temperature of between around 350 and 500° C. Due to the evaporation of the lubricant film the ability of the slugs to slip against one another is increasingly hampered as the temperature rises. At the same time, the slugs 20 expand as the temperature rises. As the slugs can no longer slip freely against each other, in a conventional annealing basket with a frame of fixed welded side plates, a pressure builds up. As the heat expansion of aluminium is around three times greater than that of steel, and aluminium softens greatly during annealing in the given temperature range, the build-up of the pressure leads to deformation in the form of recesses on the slugs in the area of the punched edges. This surface damage in the slugs 20 can for example result, leading to incorrect operation in the subsequent extrusion processes due to lack of precise fit in the area of the die, and hence interruptions in operation.

The design shown in FIG. 2*a* of a connection between a side wall 16 and a frame part 12 allows a countering of the said pressure build-up within the annealing basket 10 during the annealing process. During the heating of the annealing basket 10 filled with slugs, the high-grade aluminium profile 26 is heated to approximately the same level, i.e. the profile 26 also softens like the slugs 20. As soon as the horizontal pressure P exerted against the side walls 26 by the expansion of the slugs 20 from the inside of the annealing basket 10 exceeds a certain level, the profile 26 begins to deform plastically under the pressure of the side walls acting on this. Here the side wall 16 moves outward by a distance s of around 15 mm in the area of the upper frame part 12 (FIG. 2*b*). The deformation energy is practically fully absorbed by the profile 26 so that the slugs 20 no longer show any damage after annealing. As the heating and evaporation of the lubricant film takes place more slowly in the lower area of the annealing basket 10 compared with the upper area, it is not necessary to provide the connection between the side wall 16 and the lower frame part 12 with a plastically deformable connection. After annealing the plastically deformed profile 26 is replaced by a new profile and the annealing basket is available once more for the next annealing process.

Another design of releasable connection between a frame part 12 and a side wall 16 is shown in FIG. 3. The upper frame part is designed as a U-shaped profile frame 28, where the mutual spacing of the legs of the U-shaped profile, which is open at the base, is adapted to the thickness f of the profile 26 so that this is held by force. The deformation of the profile 26 by the build-up of pressure P during the temperature rise takes place in the same way as in the variants in FIG. 2 and here too leads to a movement of the side wall in the area of the upper frame part 12 by an amount s of the order of 15 mm (FIG. 3*b*).

A further design of releasable connection between a frame part 12 and a side wall 16 is shown in FIGS. 4 and 5. In contrast to the variant shown in FIG. 2, here the lower bracket 24 is attached to a spacer 25 which is in turn welded to the side wall 16. An angled stop 29 directed towards the inside of the annealing basket is welded to the upper frame part 12 as a reverse stop for the releasably attached side wall 16. An aluminium profile in the form of a plate is introduced between the brackets 22, 24. To secure the aluminium plate against falling when the annealing basket is being tipped or emptied, a locking bar 27 is arranged on the lower bracket 24 in the direction of tipping. The deformation of the aluminium plate 26 by the build-up of pressure P during the temperature rise takes place in a similar way to the variants in FIGS. 2 and 3 and here too leads to a movement of the side wall in the area of the upper frame part 12 by an amount s of the order of 15 mm from the reverse stop 29 until it makes contact with the upper frame part 12 (FIG. 4*b*).

The connecting system shown in FIGS. 4 and 5 has a length for example of 100 mm. The arrangement of such a connecting system approximately in the centre of the frame part usually suffices for the releasable fixing of a side wall 16 to an upper frame part 12. The aluminium plate 26 which is deformed after an annealing operation can without great force be tapped out its holder formed by the two brackets 22, 24 and replaced by a new plate for the next annealing process.

What is claimed is:

1. Steel annealing basket for holding mass-produced parts (20) of aluminum for degreasing and soft annealing, with a base (14) and side walls (16) projecting from the base (14), the sidewalls being bordered by a frame (12), characterised in that at least one side wall (16) is connected to the frame (12) by way of at least one aluminum element which deforms plastically on heating to an annealing temperature under the pressure (P) occurring in the annealing basket (10) by the heat expansion of the aluminum parts (20) against the side walls (16) so that the side wall (16), under expansion of the basket volume, is moved outwards by an extent (s) in at least one area adjacent to the frame (12).

2. Annealing basket according to claim 1, characterised in that brackets (22) are attached to at least one side wall (16) in an edge area opposite brackets (24) which are attached to the frame (12), and these together form a holder space for insertion of the element (26).

3. Annealing basket according to claim 2, characterised in that the element (26) is an aluminium profile or plate with substantially rectangular cross-section.

4. Annealing basket according to claim 1, characterised in that the frame (12) is formed as a U-shaped profile, which is open at the base, and the element (26), formed as an aluminium profile with substantially rectangular cross-section can be inserted into the U-shaped profile, and the side wall (16) lies against the side of the aluminium profile in an edge area.

* * * * *